US005481328A

United States Patent [19]

Verhoest et al.

[11] Patent Number: 5,481,328

[45] Date of Patent: Jan. 2, 1996

[54] APPARATUS FOR PROCESSING PHOTOGRAPHIC SHEET MATERIAL

[75] Inventors: Bart P. Verhoest, Kontich; Jan Claes, Heist Op Den Berg, both of Belgium

[73] Assignee: AGFA-Gevaert N.V., Mortsel, Belgium

[21] Appl. No.: 303,670

[22] Filed: Sep. 9, 1994

[51] Int. Cl.[6] ..... G03D 3/02

[52] U.S. Cl. ..... 354/324; 354/325; 354/317

[58] Field of Search ..... 354/316–325, 354/328; 134/64 R, 64 P, 122 P, 122 R; 118/412, 415, 660

[56] References Cited

U.S. PATENT DOCUMENTS 3,988,756 10/1976 Wick et al. ..... 354/319
4,327,987 5/1982 Friar et al. ..... 354/317
4,945,934 8/1990 Vaughn, IV ..... 134/64 R
4,987,438 1/1991 Goto et al. ..... 354/325 X

*Primary Examiner*—D. Rutledge
*Attorney, Agent, or Firm*—Brumbaugh, Graves, Donohue & Raymond

[57] ABSTRACT

A photographic sheet material processing apparatus comprises a pair of processing rollers, means for feeding sheet material to be processed between the processing rollers. Processing liquid distribution means supply processing liquid to the rollers. The processing liquid distribution means comprise an open-topped distributor channel positioned adjacent the processing rollers, and means for feeding processing liquid to the distributor channel along the length thereof. The distributor channel is formed with a plurality of apertures through which processing liquid passes to the rollers. Overflow means associated with the distributor channel maintain a constant liquid head therein.

18 Claims, 4 Drawing Sheets

APPARATUS FOR PROCESSING PHOTOGRAPHIC SHEET MATERIAL

FIELD OF THE INVENTION

This invention relates to apparatus for the processing of photographic sheet materials and particularly for developing exposed photographic material, and more particularly to apparatus for developing lithographic offset printing plates.

BACKGROUND OF THE INVENTION

European patent EP-A-410500 (Agfa-Gevaert NV) discloses a diffusion transfer reversal process (hereinafter called "DTR process") for obtaining a lithographic printing plate in which an imaging element is image-wise exposed and subsequently developed using a developing liquid or activating liquid in the presence of a silver halide complexing agent. The principles of the DTR process are known and have been described, for example, in U.S. Pat. No. 2,352,014 and in the book "Photographic Silver Halide Diffusion Processes" by Andre Rott and Edith Weyde—The Focal Press—London and New York (1972). In the DTR-process, non-developed silver halide of an information-wise exposed photographic silver halide emulsion layer material is transformed with a so-called "silver solvent" into soluble silver complex compounds which are allowed to diffuse into an image-receiving layer of an imaging element and are reduced therein with a developing agent generally in the presence of physical development nuclei, to form a silver image having reversed image density values with respect to the silver image obtained in the exposed photographic material.

In the processing of sheet material, such a sheet material is brought into contact with aqueous processing liquids, and rinsing water in a processing machine. In a known processing machine there is an open-topped tank divided into a number of compartments, in each of which is located at least one pair of guide rollers to define a transport path for the sheet material. Processing liquid circulates through each compartment.

The reaction between the sheet material and the processing liquid takes place in a thin reaction zone or layer of the liquid close to the surface of the sheet material. As the reaction proceeds, active chemicals in the reaction zone become used up and this zone becomes saturated with reaction products. It is necessary for fresh active chemicals to diffuse into this zone from the bulk of the liquid and for the reaction products to diffuse away. To achieve this continuous refreshment of the reaction zone, circulation of the processing liquid is often employed.

There is a need for a variety of reasons to employ processing apparatus which is as small as possible and which uses as small a volume of processing liquid as possible. Nowadays, volumes as low as 0.25 $l/m^2$ are now desirable, generating a need for even more effective refreshment of the reaction zone. While this may be achieved by increasing circulation rates, it is essential that the refreshment of the reaction zone is as uniform as possible over the width of the sheet, otherwise inconsistent processing results.

In order to obtain an aluminium based lithographic printing plate according to the DTR process generally at least three different liquids are used i.e. a developing or activating liquid, a rinsing liquid and a finisher liquid.

The developing liquid comprises a developing agent or a mixture of developing agents present in an alkaline processing solution and or these agents may be present in the photographic silver halide emulsion layer material, in which case the processing solution can be merely an aqueous alkaline solution that initiates and activates the development.

The imaging element is then guided through a diffusion transfer zone so that the silver halide complexes formed during the development step are allowed to diffuse into the image receiving layer where they are converted to silver. When the imaging element leaves the diffusion transfer zone a silver image is formed in the image receiving layer. The now useless photosensitive layer and optional other layers above the image receiving layer are then removed by guiding the imaging element through a washing and through a rinsing station.

In order to improve the printing properties, it is common practice to subject the imaged surface of the aluminium support to a chemical treatment that increases the hydrophilicity of the non-silver image parts and the oleophilicity of the silver image. This chemical after-treatment is preferably carried out with a lithographic composition called a "finisher", which comprises a compound enhancing the ink-receptivity and/or lacquer receptivity of the silver image, and also comprises at least one compound that improves the ink repelling characteristics of the hydrophilic supports. As disclosed in European patent application EPA 94200941.6 (Agfa-Gevaert NV) filed 8 Apr. 1994, such a finisher may comprise hydrophobing agents, surface-active agents and polyglycols, especially polyglycols in which ethylene oxide and/or propylene oxide groups predominate.

Not only is it necessary that each processing liquid used in the process is applied evenly over the surface of the printing plate, it is also necessary that the processing solutions be applied in a consistent manner, i.e. uniformly with respect to time. Some processing solutions, particularly the finisher liquid, may contain less soluble substances which tend to become deposited at various parts of the apparatus if the apparatus is not used for a period of time. For example liquid flow apertures may become blocked in this way, resulting in unpredictable liquid flows when the apparatus is next used.

It is an object of the present invention to provide means whereby the supply of processing liquid may be achieved in a substantially even manner over the surface of the sheet material being processed.

It is a preferred object of this invention to provide means whereby the supply of processing liquid is achieved in a substantially uniform manner, reducing the risks of the liquid supply means becoming blocked by the deposit of less soluble substances.

SUMMARY OF THE INVENTION

According to the invention there is provided an apparatus for processing photographic sheet material, comprising a pair of processing rollers, means for feeding sheet material to be processed between said processing rollers, and processing liquid distribution means for supplying processing liquid to said sheet, said processing liquid distribution means comprising an open-topped distributor channel and means for feeding processing liquid to said distributor channel along the length thereof, said distributor channel being formed with a plurality of apertures through which processing liquid passes to said sheet and overflow means associated with said distributor channel to maintain a constant liquid head therein.

The distributor channel may be so positioned to pass processing liquid directly to the sheet or more preferably via the processing rollers. In particular, the distributor channel may be so positioned that processing liquid passes to the sheet material downstream of the pair of processing rollers.

The means for feeding processing liquid may comprise a feed channel positioned above and substantially parallel to the distributor channel, the feed channel having a plurality of liquid feed passages through which processing liquid passes from the feed channel to the distributor channel. The feed channel is preferably formed with a plurality of apertures to constitute the liquid feed passage.

The distributor channel may comprise side walls the height of which predetermine a liquid level in the distributor channel, and front and back longitudinally extending walls interconnected by a base wall, the front and back walls having top edges positioned above the liquid level. The apertures are preferably formed in the base wall. In a preferred embodiment of the invention, the base wall is an inclined base wall, for example inclined at an angle of up to 30°, such as between about 5° and about 25° to the horizontal, ideally between about 10° and 20° to the horizontal. Advantageously, the apertures are formed in the inclined base wall towards the lower extreme thereof.

The apertures in the distributor channel and those which constitute the feed passages of the feed channel are preferably equally spaced, and are preferably of equal size. We also prefer that these apertures are circular.

In a particular embodiment, the apertures in the distributor channel have a mutual spacing of from 10 to 100 mm, such as from 30 mm to 70 mm and a diameter of from 1 to 10 mm, such as from 3 to 7 mm. Advantageously, the size and distribution of the apertures in the distributor channel and the height of the liquid head are such, in relation to the viscosity of the processing liquid, as to provide substantially uniform distribution of the processing liquid to the sheet material.

The size and distribution of the apertures which constitute the feed passage of the feed channel are not so critical, provided that they are sufficient in size and number to ensure that sufficient processing liquid passes therethrough to the distributor channel to maintain the liquid head therein.

In an embodiment of the invention where the means for feeding processing liquid comprises a feed channel positioned above and substantially parallel to the distributor channel, the feed channel having a plurality of liquid feed passages through which processing liquid passes from the feed channel to the distributor channel, it is advantageous that the distribution channel and the feed channel are carried on a common frame. This arrangement is convenient for maintenance purposes.

In a suitable processing machine embodying the invention, there is an open-topped tank divided into a number of compartments, each of which has opposite side plates carrying at least one pair of guide rollers to define a transport path for the sheet material. The transport path may be further defined by one or more guide plates and/or by at least a second pair of guide rollers. In particular, the transport path may be defined by an entry pair of guide rollers and an exit pair of guide rollers. Guide plates may be located between each pair of guide rollers. Where a compartment of the tank includes at least two pairs of processing rollers, the distributor channel may be so positioned to pass processing liquid to the sheet intermediate the pairs of processing rollers. Each pair of processing rollers may have an associated distributor channel, carried on a common frame.

The present invention also provides a liquid distributor channel for supplying processing liquid to sheet material in a sheet material processing apparatus, the distributor channel comprising side walls the height of which predetermine a liquid level in the distributor channel, front and back longitudinally extending walls interconnected by an inclined base wall, the front and back walls having top edges positioned above the liquid level, and a plurality of apertures formed in the base wall towards the lower extreme thereof.

In a method for processing photographic sheet material using an apparatus comprising a pair of processing rollers and means for feeding sheet material to be processed between the processing rollers, the present invention provides the improvement comprising supplying processing liquid to sheet material by use of distribution means comprising an open-topped distributor channel, and feeding processing liquid to the distributor channel along the length thereof, the distributor channel being formed with a plurality of apertures through which processing liquid passes to the sheet material and overflow means associated with said distributor channel to maintain a constant liquid head therein. The processing liquid is, in particular, a lithographic printing plate finisher solution.

The sheet material to be processed may be an imaging element as described above, containing an aluminium support provided with an image receiving layer and a silver halide emulsion. The support may alternatively be constituted by other materials, such as polyester.

BRIEF DESCRIPTION OF THE DRAWINGS

The invention will now be further described, purely by way of example, by reference to the accompanying drawings in which.

PREFERRED EMBODIMENT OF THE INVENTION

Figure 1:
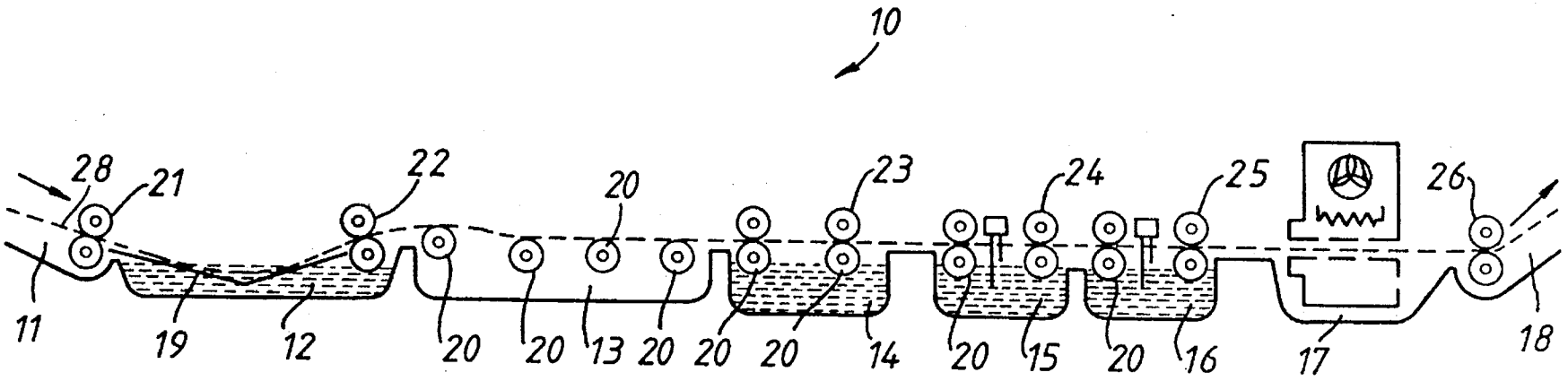
FIG. 1 illustrates schematically a DTR processing apparatus.

The processing apparatus 10 (FIG. 1) is mounted within a generally rectangular housing which may include a rectangular metal mainframe (not shown for reason of simplicity) for supporting the various sections of the apparatus. The apparatus 10 thus may comprise a sheet feed means 11, preferably a pair of feeding rollers 21, a developing section 12, a diffusion transfer section 13, a wash section 14, a rinse section 15, a finisher section 16, a drier section 17, and an output section 18 with output rollers 26. All these sections may include conveyor rollers generally designated with the reference 20.

Each processing section of the apparatus preferably includes one pair of rollers at the inlet thereof and one pair of rollers at the outlet. Specifically, the exit ends of the developing section 12, the washing section 14, the rinsing station 15 and the finisher section 16 have sets of squeegee rollers 22, 23, 24 and 25 to remove excess liquid from the sheet material as it exits the respective section.

Each pair of rollers associated with a liquid processing section is so arranged that the lower member of the pair lies partly below the liquid level in that section.

If in FIG. 1 the upper roller of the processing rollers is rotating anticlockwise and both the processing rollers are biased together, e.g. by springs means, the lower roller of the processing rollers is driven clockwise to pass sheet material 28 through the rollers and towards the output 18 of the processing apparatus 10. The drive applied to these rollers therefore acts to feed the sheet material 28 through the apparatus. Guide surfaces, such as that illustrated by the reference 19 in FIG. 1, ensure the transport path of the sheet material 28 between the rollers of each successive pair.

Figure 2:
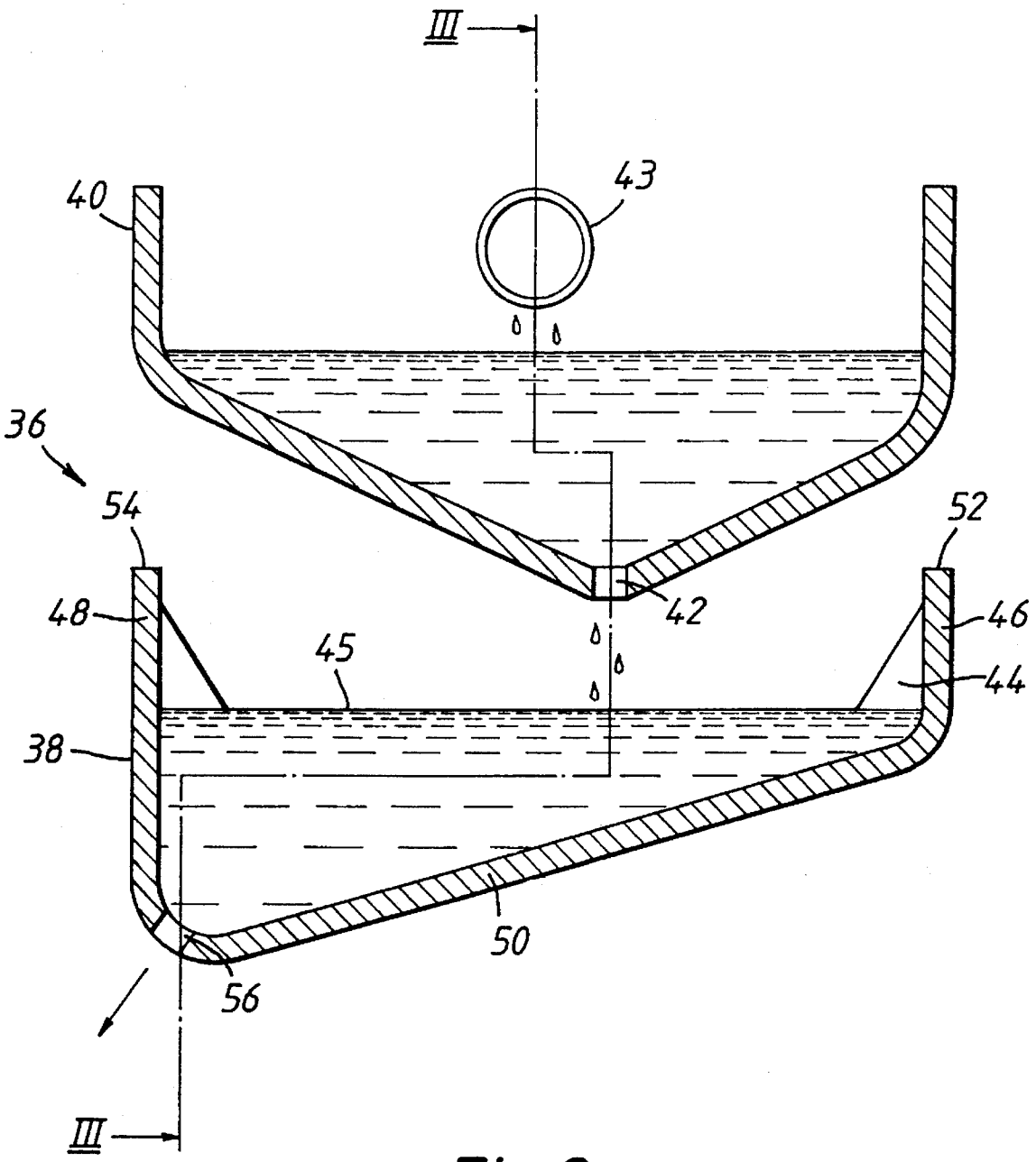
FIG. 2 is a cross-section of processing liquid distribution means according to the invention.
Figure 3:
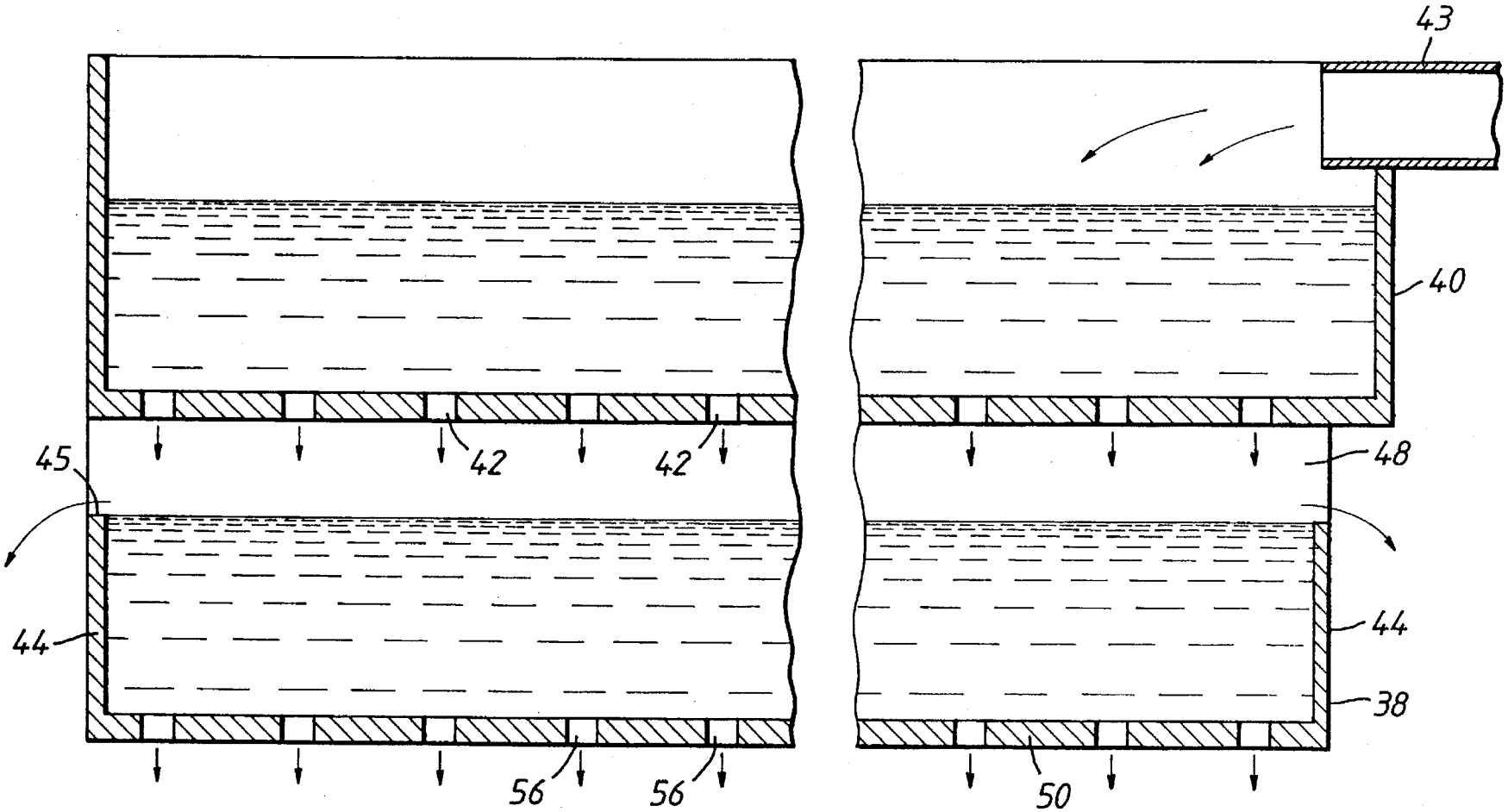
FIG. 3 shows a lateral section of the distributing means shown in FIG. 2, taken on the line III—III in FIG. 2.
Figure 4:
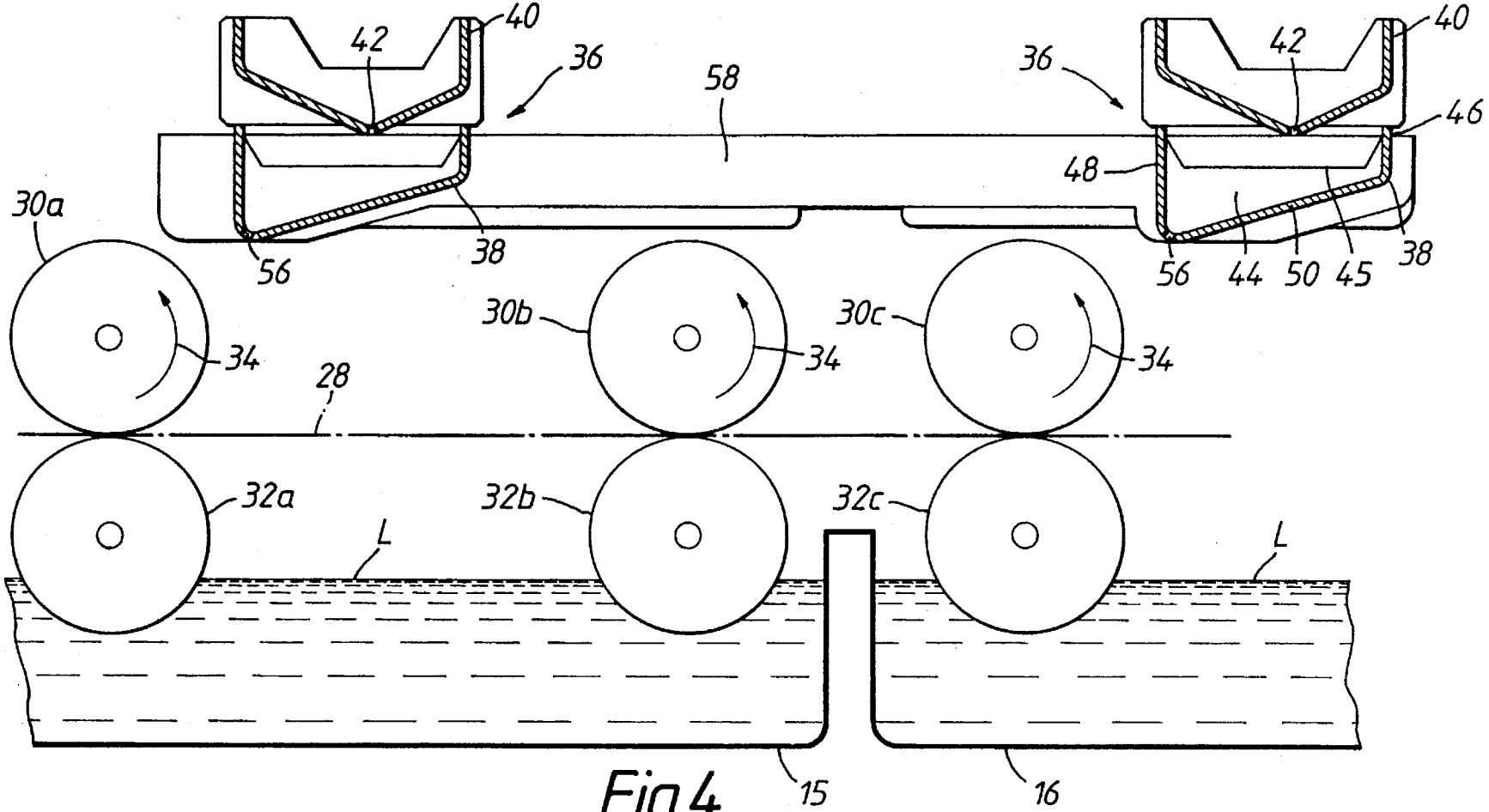
FIG. 4 shows schematically the positioning of the processing liquid distributing means shown in FIGS. 2 and 3, relative to the processing rollers of a sheet material processing apparatus according to the invention.

The apparatus for processing photographic sheet material shown in FIGS. 2 to 4 comprises pairs of processing rollers 30*a,b,c*, 32*a,b,c*, two such pairs being provided in each of the processing stations 15 and 16 (for the sake of clarity one such pair of rollers associated with processing station 16 is omitted from FIG. 4). Each pair of rollers is so arranged that the lower member 32*a,b,c* of the pair lies partly below the liquid level L in that processing station.

Feed means in the form of a drive 34 applied to each of the top rollers 30*a,b,c* provide for feeding sheet material 28 to be processed.

Distribution means 36 supply processing liquid to the sheet material 28 after the sheet material passes through the upstream pair of rollers 30*a*, 32*a* in processing station 15 and the upstream pair of rollers 30*c*, 32*c* in processing station 16. The processing liquid used in station 15 is, for example, rinse water while the processing liquid used in station 16 is, for example, a lithographic printing plate finisher solution. A typical formula of a lithographic printing plate finisher solution is as follows:

| | |
|---|---|
| AKYPO-OP-80 (Trade Mark for a surfactant sold by Chemische Fabrik Chem-Y GmbH, Germany) | 0.25 g |
| $NaH_2PO_4.2H_2O$ | 20 9 |
| potassium nitrate | 12.5 g |
| citric acid | 20 9 |
| 2-mercapto-5-n.heptyl-oxa-3,4-diazole | 0.5 g |
| sodium hydroxide | 5.5 g |
| PEG 3000 {$HO(CH_2CH_2O)_{66}H$ - a waxy powder with a molecular weight of 2700 to 3300} | 20 g |
| water to make | 1000 ml |

The distribution means 36 comprise an open-topped distributor channel 38 horizontally positioned adjacent the processing rollers 30*a,b,c*, 32*a,b,c*. A feed channel 40 is positioned above and parallel to the distributor channel 38 for feeding the appropriate processing liquid to the distributor channel 38 along the length thereof. The feed channel 40 has a plurality of equally spaced, equally sized, circular feed apertures 42 having a diameter of 5 mm and a mutual spacing of 50 mm. These feed apertures 42 together constitute a liquid feed passage through which processing liquid passes from the feed channel 40 to the distributor channel 38. Processing liquid is fed to the feed channel by way of an open-ended supply pipe 43 (shown in FIGS. 2 and 3) fed with processing liquid via a pump (not shown). The processing liquid may be recirculated.

The distributor channel 38 comprises side walls 44 having horizontal upper edges 45, the height of which predetermine a liquid level in the distributor channel 38. Front and back longitudinally extending walls 46, 48 are interconnected by an inclined base wall 50, the front and back walls 46, 48 having top edges 52, 54 positioned above the liquid level. The inclined base wall 50 extends at an angle of between about 15° to the horizontal. As illustrated in FIG. 3, the side walls 44 constitute overflow means associated with the distributor channel 38 to maintain a constant liquid head therein. Processing liquid which flows over the side walls 44 may be arranged to fall into a sump of that compartment of the apparatus, subsequently to be recycled to the supply pipe 43.

The distributor channel 38 has a plurality of equally spaced, equally sized, circular distributor apertures 56 through which processing liquid passes to the rollers 30, 32. The distributor apertures 56 are formed in the inclined base wall 50 towards the lower extreme thereof.

By forming the distributor apertures 56 at the lowest point in this manner, it is assured that when the apparatus is left idle for a period of time, substantially all the processing liquid drains out of the distributor channel 38, reducing the risk of less soluble ingredients of the processing liquid being deposited and causing a blockage of the distributor apertures 56. The distributor apertures 56 have a mutual spacing of about 50 mm and a diameter of about 5 mm. The size and distribution of the distributor apertures 56 and the height of the liquid head are such, in relation to the viscosity of the processing liquid, as to provide substantially uniform distribution of the processing liquid to the sheet material 28.

The distribution channel 38 and the feed channel 40 are carried on a common frame 58. Each pair of processing rollers has an associated distributor channel 38 and feed channel 40, carried on the common frame. The frame can be removed from the tank during maintenance, thereby allowing access to the rollers 30, 32 and other parts of the apparatus.

Reference No. List

| | |
|---|---|
| processing apparatus 10 | processing rollers 30, 32 |
| sheet feed means 11 | drive 34 |
| developing section 12 | Distribution means 36 |
| transfer section 13 | distributor channel 38 |
| wash section 14 | feed channel 40 |
| rinse section 15 | feed apertures 42 |
| finisher section 16 | supply pipe 43 |
| drier section 17 | side walls 44 |
| output 18 | horizontal upper edges 45 |
| Guide surfaces 19 | Front wall 46 |
| conveyor rollers20 | back wall 48 |
| feeding rollers 21 | base wall 50 |
| squeegee rollers 22, 23, | top edges 52, 54 |
| 24, 25 | distributor apertures 56 |
| output rollers 26 | frame 58 |
| sheet material 28 | liquid level L |

We claim:

1. An apparatus for processing photographic sheet material, comprising a pair of processing rollers, means for feeding sheet material to be processed between said processing rollers, and processing liquid distribution means for supplying processing liquid to said sheet, said processing liquid distribution means comprising an open-topped distributor channel and means for feeding processing liquid to said distributor channel along the length thereof, said distributor channel being formed with a plurality of apertures through which processing liquid passes to said sheet and overflow means associated with said distributor channel to maintain a constant liquid head therein.

2. An apparatus according to claim 1, including at least two pairs of processing rollers, said distributor channel being so positioned to pass processing liquid to said sheet intermediate said pairs of processing rollers.

3. An apparatus according to claim 1, said distributor channel being so positioned to pass processing liquid to said sheet via said processing rollers.

4. An apparatus according to claim 1, including at least two pairs of processing rollers, each of said pairs of processing rollers having an associated distributor channel carried on a common frame.

5. An apparatus according to claim 1, wherein said means for feeding processing liquid comprises a feed channel positioned above and substantially parallel to said distributor channel, said feed channel having a plurality of liquid feed passages through which processing liquid passes from the feed channel to said distributor channel.

6. An apparatus according to claim 5, wherein said feed channel is formed with a plurality of apertures to constitute said liquid feed passages.

7. An apparatus according to claim 1, wherein said distributor channel comprises side walls the height of which predetermine a liquid level in said distributor channel, and front and back longitudinally extending walls interconnected by a base wall, said front and back walls having top edges positioned above said liquid level.

8. An apparatus according to claim 7, wherein said apertures are formed in said base wall.

9. An apparatus according to claim 7, wherein said base wall is an inclined base wall.

10. An apparatus according to claim 9, wherein said inclined base wall extends at an angle of between 0° and about 30° to the horizontal.

11. An apparatus according to claim 10, wherein said apertures are formed in said inclined base wall towards the lower extreme thereof.

12. An apparatus according to claim 11, wherein said apertures have a mutual spacing of from 10 to 100 mm.

13. An apparatus according to claim 12, wherein said apertures have a diameter of from 1 to 10 mm.

14. In a method for processing photographic sheet material using an apparatus comprising a pair of processing rollers and means for feeding sheet material to be processed between said processing rollers, the improvement comprising supplying processing liquid to sheet material by use of distribution means comprising an open-topped distributor channel, and feeding processing liquid to said distributor channel along the length thereof, said distributor channel being formed with a plurality of apertures through which processing liquid passes to said sheet material and overflow means associated with said distributor channel to maintain a constant liquid head therein.

15. A method according to claim 14, wherein said distributing channel is so positioned that processing liquid passes to said sheet material downstream of said pair of processing rollers.

16. A method according to claim 14, wherein said photographic sheet material is constituted by an imaging element.

17. A method according to claim 14, wherein said processing liquid is a lithographic printing plate finisher solution.

18. A method according to claim 17 wherein the size and distribution of said apertures and the height of said liquid head are such, in relation to the viscosity of said processing liquid, as to provide substantially uniform distribution of said processing liquid to said sheet material.

* * * * *